US005209556A

United States Patent [19]

Anderson

[11] Patent Number: 5,209,556

[45] Date of Patent: May 11, 1993

[54] DRAWER ASSEMBLY

[76] Inventor: Robert F. Anderson, 5300 13th St., Menominee, Mich. 49858

[21] Appl. No.: 829,490

[22] Filed: Feb. 3, 1992

Related U.S. Application Data

[62] Division of Ser. No. 678,644, Apr. 1, 1991, Pat. No. 5,099,529.

[51] Int. Cl.[5] ..... A47B 88/04

[52] U.S. Cl. ..... 312/334.27; 312/348.2

[58] Field of Search ..... 312/330.1, 348.1, 348.2, 312/341.1, 344.1, 334.27

[56] References Cited

U.S. PATENT DOCUMENTS

| | | | |
|---|---|---|---|
| 1,169,328 | 1/1916 | Holtgrewe | 312/348.1 X |
| 1,268,063 | 5/1918 | Cochran | 312/341.1 |
| 2,462,524 | 2/1949 | Mattedi . | |
| 2,483,938 | 10/1949 | Royston . | |
| 3,650,592 | 3/1972 | Williams | 312/348.1 |
| 3,745,596 | 7/1973 | Copeland . | |
| 4,110,854 | 9/1978 | Sjolie . | |
| 4,613,999 | 9/1986 | Franco . | |
| 4,617,689 | 10/1986 | Nelson . | |
| 4,805,970 | 2/1989 | Scalf | 312/330.1 |
| 4,807,315 | 2/1989 | Wachenheim . | |
| 4,934,765 | 6/1990 | Slifer . | |
| 5,076,723 | 12/1991 | Berger | 312/330.1 X |
| 5,099,529 | 3/1992 | Anderson | 5/400 |

FOREIGN PATENT DOCUMENTS 218496 7/1924 United Kingdom .

OTHER PUBLICATIONS

REP Corporation Brochure, Jun. 1981.

Waterbed Magazine/Jun. 1988 "Rails and Pedestals".

*Primary Examiner*—Peter R. Brown

*Attorney, Agent, or Firm*—C. Kenneth Bjork

[57] ABSTRACT

Disclosed is a drawer which can be manufactured in kit form for compact shipping and is easily assembled using hand tools. The side, bottom, front and back of the drawer are configured such that these members contain grooves, notches and predrilled holes to assure ready assembly and securing of these members in assembling the drawer.

6 Claims, 1 Drawing Sheet

DRAWER ASSEMBLY

CROSS-REFERENCE TO RELATED APPLICATION

This application is a division of application Ser. No. 07/678,644 filed Apr. 1, 1991, and issued as U.S. Pat. No. 5,099,529.

BACKGROUND OF THE INVENTION

1. Field of the Invention

The present invention relates to a drawer assembly and more particularly is directed to a drawer which is manufactured in kit form for shipping in compact form and is readily assembled using hand tools.

2. Description of Related Art

A wide variety of drawers and storage compartments are known in the art. Examples are shown in U.S. Pat. No. 4,617,689, U.S. Pat. No. 3,745,596, U.S. Pat. No. 4,613,999, U.S. Pat. No. 2,462,524, U.S. Pat. No. 4,934,765, U.S. Pat. No. 4,807,315 U.S. Pat. No. 4,110,854 and U.S. Pat. No. 2,483,938 directed to drawers used in bed pedestals or bed frames. None of these disclose a drawer assembly which as manufactured can be packed compactly for shipping and marketing and then be assembled without knowledge of a high degree of carpentry skills using only a screwdriver. The drawer of the present invention accomplishes this.

SUMMARY OF THE INVENTION

The drawer of the present invention comprises a front, two sides, a bottom and a back which can be manufactured, packaged and shipped in kit form and readily can be fitted and secured together to provide the final assembly.

DESCRIPTION OF THE PREFERRED EMBODIMENT

The following description will enable anyone reasonably skilled in using a simple hand tool, i.e. a screwdriver, to assemble the drawer of the present invention. It also sets forth the best mode contemplated by the inventor for making and using the present invention.

Figure 1:
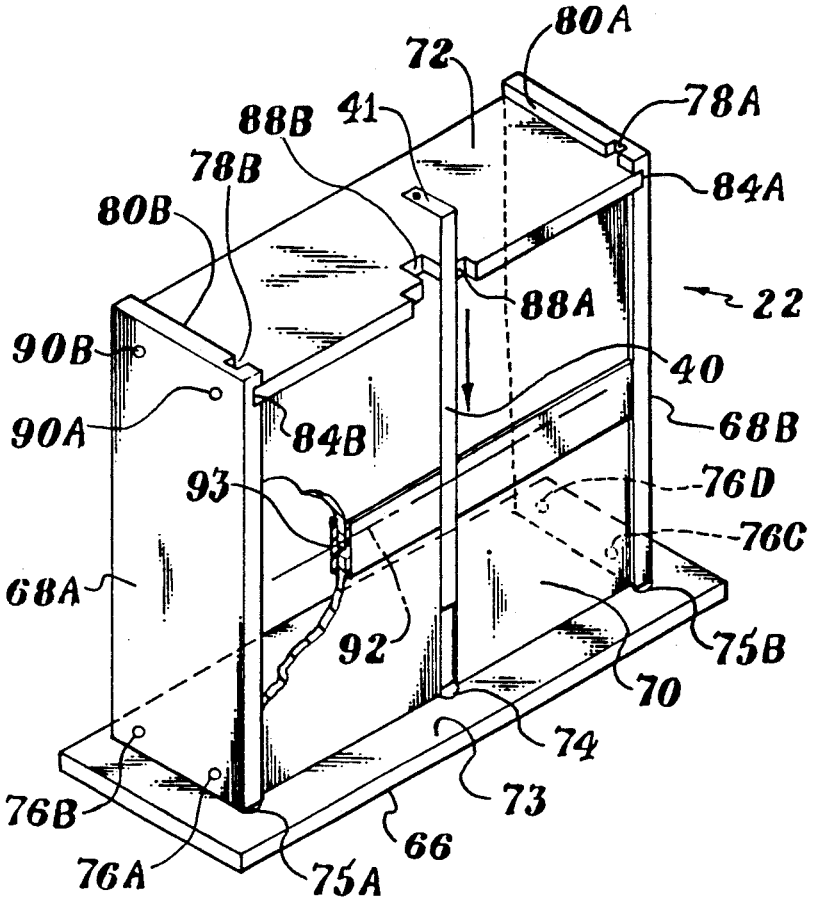
FIG. 1 is a side perspective view of the drawer.
Figure 2:
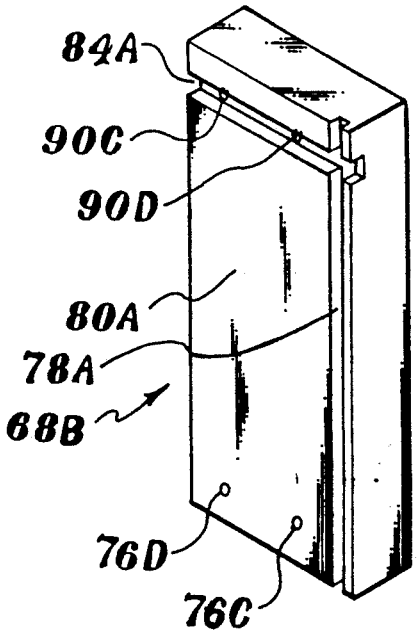
FIG. 2 is a side perspective view of a side member of the drawer.

FIG. 1 discloses a side perspective view of the drawer 22. In the embodiment shown in FIG. 1, the drawer unit 22 comprises a front 66, two sides 68A and 68B, a bottom 70 and a back 72. The middle of the inside face 73 of drawer front 66 contains a depression 74 near the bottom designed to hold in place one end of a drawer slide 40. The depression 74 mates with drawer slide member 40 and holds the one end of member 40 in place without the need of an additional fastener. Drawer face 73 also has vertical grooves 75A and 75B at predetermined distances inwardly from its ends such that one end of each of the drawer sides 68A and 68B fits snugly therein. The positioning of sides 68A and 68B provides that these fit snugly but slidably within the side walls of a given drawer frame. Preferably, sides 68A and 68B have angularly, downwardly predrilled holes 76A, 76B, 76C and 76D near the ends fitted in grooves 75A and 75B to facilitate securing the sides 68A and 68B to the drawer front 66 with screws or other fastening means. Each side member 68A and 68B has narrow grooves 78A and 78B in the interior face 80A and 80B near the edge which will be near the bottom of a drawer 22 and slidably engage drawer bottom 70. These extend horizontally along the length of each side 68A and 68B. Drawer bottom 70 is slid into these grooves 78A and 78B during assembly. Sides 68A and 68B also each contain a vertical groove 84A and 84B near the end opposite that which fits into depressions 75A and 75B. These grooves 84A and 84B hold the back 72. Back 72 can contain a horizontal slot (not shown) which mates with the grooves 78A and 78B to help position and hold the bottom 70. Back 72 has a slot 88B which is centrally positioned to automatically locate and hold the mating second end of slide 40. This second end of slide 40 has a right angle tail 41 which fits snugly into slot 88B and is fastened with a screw. Back 72 also has a notch 88A which is also centrally located and is of a size and configuration to allow passage along a mating drawer slide in a drawer frame, such as in a bed frame for example, when the drawer 22 is opened or closed. Side members 68A and 68B preferably will have spaced-apart predrilled openings 90A, 90B, 90C and 90D positioned such that screws or other appropriate fasteners will pass through and be guided into the ends of back 72. To reduce size for shipping, the drawer bottom 70 can be made in one piece folded over along its center lines 92, or two peices, generally of the same shape and size, i.e. substantially identical which can be taped together at their mating edges. The two pieces can be joined, for example, by means of a H shaped extrusion 93 to reduce width for packaging without destroying the integrity of this member 70.

In the preferred embodiment of the drawer described hereinbefore and shown in the figures of the drawing, for ease of assembly by the retailer or user, it has been manufactured in kit form for ready assembly with screws using only a screwdriver. However, if desired, it is contemplated that other means of securing the various components to each other can be used. There include, for example, adhesives, glues, nails and the like. However, for ease in assembly and disassembly, as well as providing a good, secure drawer, use of screws is a convenient way of securing the components.

As shown and described, the preferred drawer embodiment is constructed of wood, preferably pine or any other wood generally used for furniture construction. Cedar is particularly desirable to provide moth protection. Other materials could be used but these might require alternate securing and assembly means as will be known to one skilled in the art.

Various modifications cap be made in the present invention without departing from the spirit or scope thereof for it is understood that I intend that my invention be limited only by the scope of the appended claims.

I claim:

1. A drawer assembly which comprises in combination a front, two sides, a bottom, a back and a drawer slide, the drawer front containing a depression near the bottom at the center of the interior face to hold one end of one half of a drawer slide member, said interior face also having vertical grooves at predetermined distances inwardly from its ends, one end of each of the sides fitting snugly but slidably within said vertical grooves, each of said sides having narrow grooves in its interior face near the bottom edge extending horizontally along the length of each side, said grooves slidably engaging the drawer bottom and each of said drawer sides defining a vertical groove near the end opposite that which fits into the grooves in the drawer face, said grooves in the sides holding the back of the drawer, the back of said drawer defining a notch and slot centrally positioned in its bottom, said slot extending upwardly from the center of the upper extent of the notch and locating and holding the mating second end of said slide, said second end of said slide having a right angle tail, said tail fitting snugly into said slot and being fastened to the back of said drawer and said notch being of a size and configuration allowing passage along a mating drawer slide in a drawer frame.

2. The drawer as defined in claim 1 having at least one angularly positioned opening near the end of each side fitted into the grooves in the face and fastening means positioned in said openings securing the sides to the drawer face.

3. The drawer as defined in claim 1 having a narrow groove in the interior face of the back near its bottom edge mating with those in the sides which slidably engages the drawer bottom.

4. The drawer as defined in claim 1 wherein the drawer bottom is comprised of two substantially equally sized planar members, each of which makes up one half of the bottom and said planar members being joined together at their mating edges.

5. The drawer as defined in claim 4 wherein the two halves of the drawer bottom are secured by tape at their mating edges.

6. The drawer as defined in claim 4 wherein the mating edges of the two halves of the drawer bottom are fitted into and held together by an H shaped fastener extending along the length of said mating edges.

* * * * *